United States Patent [19]

Takeuchi

[11] Patent Number: 4,796,505

[45] Date of Patent: Jan. 10, 1989

[54] TREMOLO ARM ADJUSTMENT MECHANISM IN ELECTRIC GUITAR

[76] Inventor: Toshitaka Takeuchi, 28, Azanakasandanbata, Ooazasaitou, Fusou-cho, Niwagun, Aichi-ken, Japan

[21] Appl. No.: 123,596

[22] Filed: Nov. 20, 1987

[30] Foreign Application Priority Data

Nov. 26, 1986 [JP] Japan ..... 61-181290[U]

[51] Int. Cl.[4] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 3,241,418 | 3/1966 | Fender | 84/313 |
| 4,638,711 | 1/1987 | Stroh | 84/313 |
| 4,656,915 | 4/1987 | Osuga | 84/313 |
| 4,671,157 | 6/1987 | Fender | 84/313 |
| 4,681,011 | 7/1987 | Hoshino | 84/313 |

*Primary Examiner*—Lawrence R. Franklin

*Attorney, Agent, or Firm*—Wenderoth, Lind & Ponack

[57] ABSTRACT

In a tremolo arm adjustment mechanism in an electric guitar, a tremolo unit is provided with a mounting hole for the tremolo arm penetrating through a body section and a block section in the vertical direction, a male screw portion threaded on base portion of the tremolo arm is threadedly engaged with the mounting hole from upper side in freely traveling state, a torque adjusting screw is threadedly engaged with the mounting hole from lower side in freely traveling state, and a spring is interposed between the torque adjusting screw and the male screw portion, thereby mounting height and rotational torque of the tremolo arm can be adjusted individually.

2 Claims, 3 Drawing Sheets

TREMOLO ARM ADJUSTMENT MECHANISM IN ELECTRIC GUITAR

BACKGROUND OF THE INVENTION

1. Field of the Invention

The present invention relates to improvement of a tremolo arm portion to be mounted on a tremolo unit for vibrato performance in an electric guitar, and more specifically to improvement to perform height adjustment and rotational torque adjustment of the tremolo arm.

2. Description of the Prior Art

In electric guitars in general, a tremolo unit is installed at body side and one end of a string is hooked to the tremolo unit, and on the other hand a peg is installed at neck side and other end of the string is wound on the peg. The tremolo unit has front end portion pivotally installed to the body and is movable in the vertical direction. A tremolo arm is mounted on the tremolo unit and is operated to rotate the tremolo unit downward so as to perform the up action of tone by increasing tension of strings, or to rotate it upward so as to perform the down action of tone by decreasing the tension of the strings, and this action is repeated in a short time thus the vibrato performance is feasible. The tremolo arm is usually engaged rotatably with the tremolo unit, and height of the mounting position of the tremolo arm and strength of its rotational torque can be adjusted according to the tightening state of the threaded portion corresponding to the music program and preference of the player. More specifically, a male screw portion threaded on base portion of the tremolo arm is threadedly engaged with a mounting hole (tapped hole) opened to the tremolo arm so that the height adjustment and the rotational torque adjustment can be performed.

In a tremolo arm in the prior art as above described, the male screw portion is threadedly engaged with the mounting hole (tapped hole) thereby the height adjustment and the rotational torque adjustment can be performed. In this case, however, conflict occurs between following states:

(1) That when the male screw portion is rotated in the loosening direction and the mounting position is set high, the rotational torque of the tremolo arm becomes small, and (2) that when the male screw portion is rotated strongly in the tightening direction (when the tightening state of the threaded portion is made firm) in order that the rotational torque of the tremolo arm is set large, height of the mounting position of the tremolo arm becomes low.

SUMMARY OF THE INVENTION

An object of the invention is to provide a tremolo arm adjustment mechanism in an electric guitar wherein height adjustment of the tremolo arm of the electric guitar and rotational torque adjustment thereof can be performed independently.

Another object of the invention is to provide a tremolo arm adjustment mechanism in an electric guitar wherein even if height of the tremolo arm is varied the rotational torque can be held constant.

Still another object of the invention is to provide a tremolo arm adjustment mechanism in an electric guitar wherein height of the tremolo arm is made constant and the rotational torque is varied.

In order to attain the foregoing objects, the present invention has following essential constitution requirements.

In an electric guitar where a tremolo unit is composed of a body section to hold a bridge saddle thereon and a block section extending downward from the body section, and the tremolo unit has front end portion pivotally installed to the body and is rotatable in the vertical direction, and a tremolo arm is mounted on the tremolo unit, (1) that the tremolo unit is provided with a mounting hole for the tremolo arm penetrating through the body section and the block section in the vertical direction, and (2) that a male screw portion threaded on base portion of the tremolo arm is threadedly engaged with the mounting hole from upper side in freely traveling state, and on the other hand a torque adjustment screw is threadedly engaged with the mounting hole from lower side in freely traveling state, and further a spring is interposed between the torque adjustment screw and the male screw portion.

DESCRIPTION OF THE PREFERRED EMBODIMENTS

Figure 1:
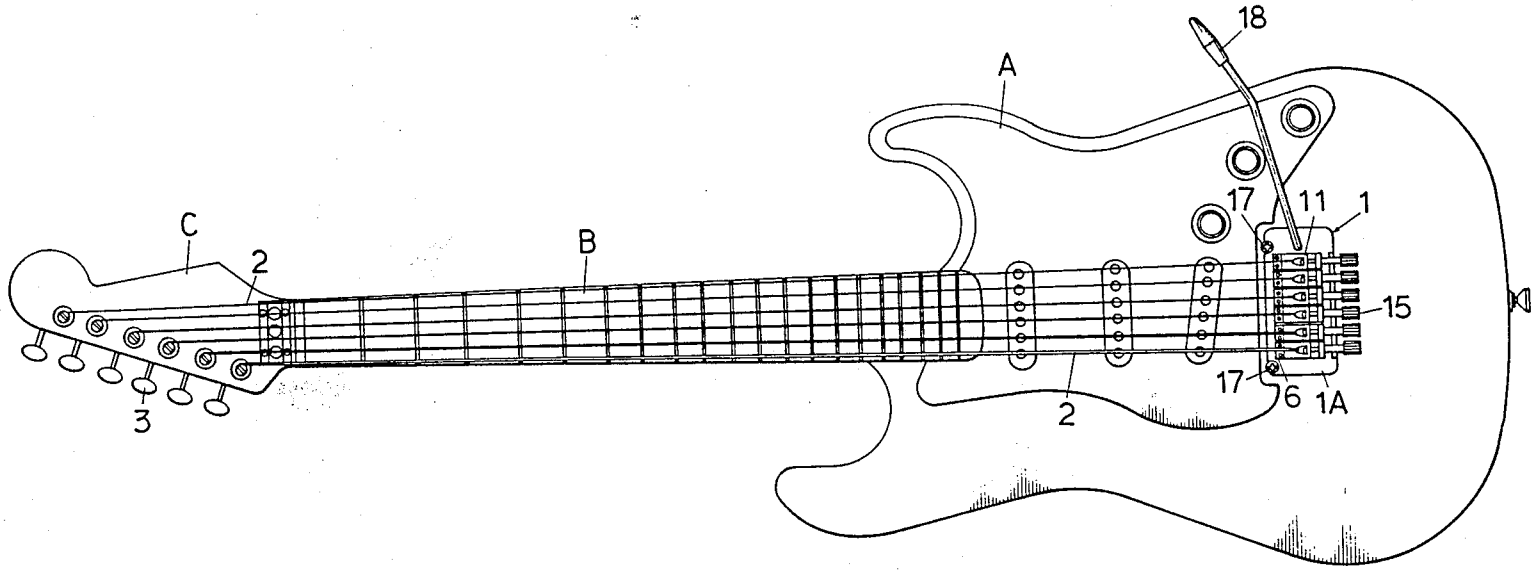
FIG. 1 is a plan view illustrating an electric guitar as a whole having a tremolo arm adjustment mechanism of the invention.
Figure 2:
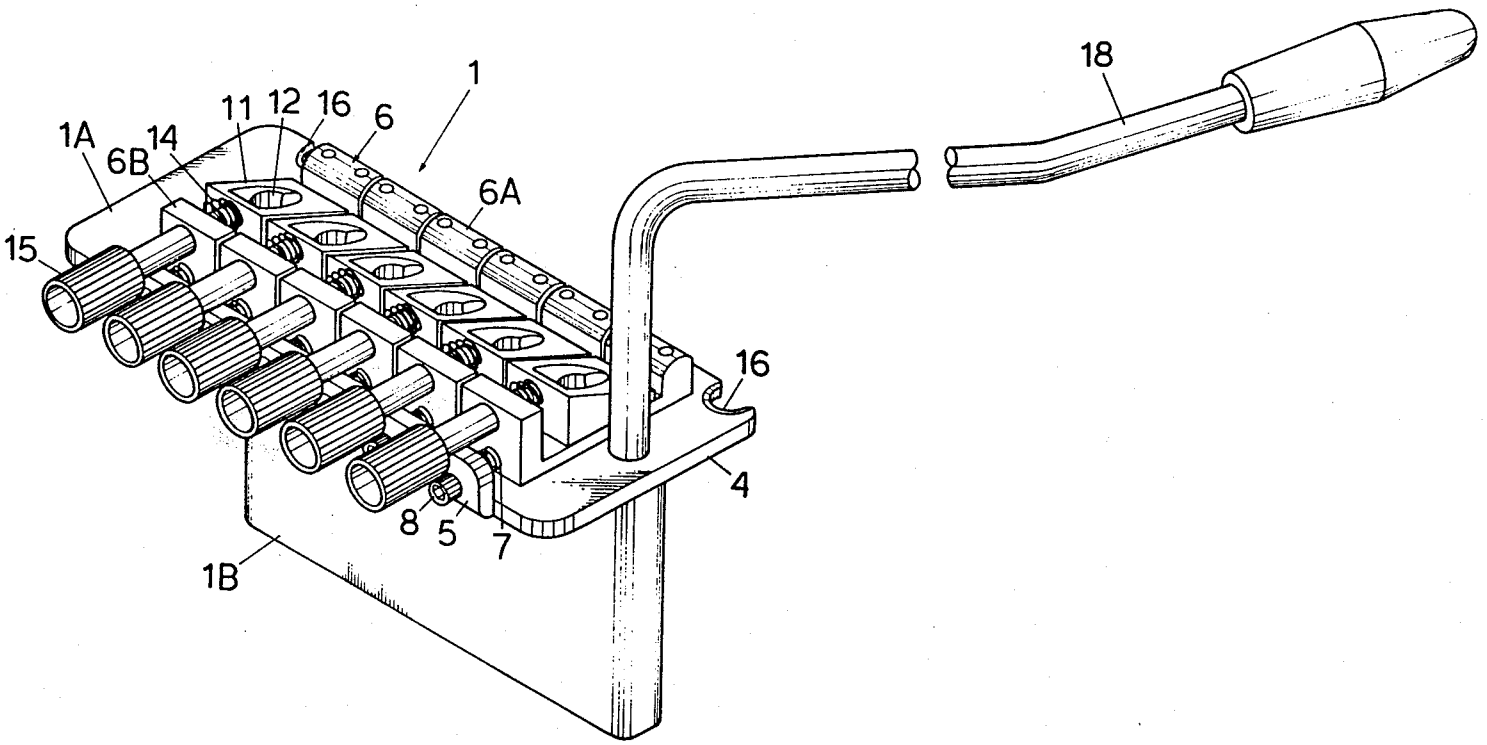
FIG. 2 is a perspective view illustrating appearance of a tremolo unit.
Figure 3:
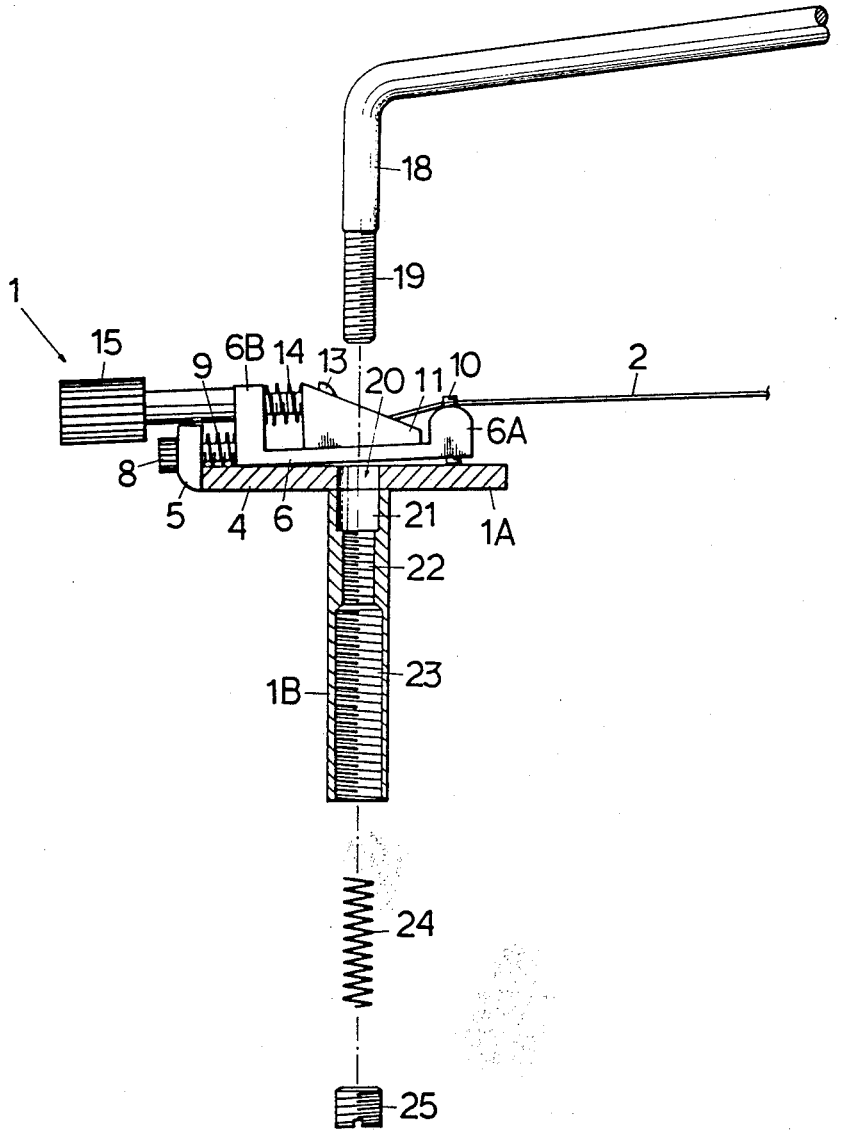
FIG. 3 is a side sectional view of a tremolo unit representing a tremolo arm adjustment mechanism.

In FIGS. 1~3, A designates a body of an electric guitar, B designates a neck, and C designates a head. A tremolo unit 1 of knife edge type is installed at side of the body A and one end of a string 2 is hooked to the tremolo unit 1, and on the other hand a peg 3 is installed at side of the neck B and other end of the string 2 is wound on the peg 3.

The tremolo unit 1 comprises a body section 1A, and a block section 1B which is perpendicular downward to the body section 1A. The body section 1A is composed of a horizontal portion 4 and a vertical portion 5 rising from rear end side of the horizontal portion 4, and therefore is formed in L-like shape. A plurality of bridge saddles 6 with the number corresponding to that of strings 2 are installed on the body section 1A so that they are freely adjustable in traveling adjustment (octave adjustment). That is, each bridge saddle 6 is held on the horizontal portion 4 and extends in the longitudinal direction, and a through hole (not shown) opposed to each bridge saddle 6 is bored on the vertical portion 5. A tapped hole 7 for the octave adjustment is bored on a rear wall portion 6B of each bridge saddle 6 as hereinafter described, and on the other hand an octave adjusting screw 8 is loosely fitted to the through hole and a top end threaded portion of the screw 8 is threadedly engaged with the tapped hole 7 and can be freely traveled. A spring 9 is interposed between the bridge saddle 6 and the vertical portion 5 against each adjusting screw 8, and each adjusting screw 8 and each bridge saddle 6 are normally biased forward. Each bridge saddle 6 is provided at front end portion with a saddle portion 6A and at rear end portion with the rear wall portion 6B respectively projecting integrally. String height adjusting screws 10, 10 penetrate both lateral end portions of the saddle portion 6A vertically and are threadedly engaged with the saddle portion 6A and movable up and down. A slider 11 for fine tuning is interposed between the saddle portion 6A and the rear wall portion 6B, and is held on the bridge 6 and movable in the longitudinal direction. Each slider 11 has a slant surface at top end portion and is formed in a right triangle viewing from the lateral side, and a through hole 12 for the string 2 is opened to the vertical direction of the slider 11. An adjustment screw rod 13 is projected rearward at rear wall portion of the slider 11, and top end portion of the adjustment screw rod 17 penetrates a through hole (not shown) opened at the rear wall portion 6B of the bridge saddle 6 and faces to rear side from the rear wall portion 6B. A spring 14 is interposed between the slider 11 and the rear wall portion 6B of the bridge saddle against each adjustment screw rod 13, so that each adjustment screw rod 13 and each slider 11 are normally biased forward. A fine tuning screw 15 is threadedly engaged with the adjustment screw rod 13 and movable in the horizontal direction, and top end portion of the fine tuning screw 15 abuts on the rear wall portion 6B of the bridge saddle 6.

Numeral 18 designates a tremolo arm for rotating the tremolo unit 1 vertically. The tremolo arm 18 is bent in L-like shapes and a male screw portion 19 is threaded on base portion of the tremolo arm 18. A mounting hole 20 for the tremolo arm 18 is bored on the body section 1A of the tremolo unit 1 at lateral side of the bridge saddle 6 arranged on the body section 1A, and the male screw portion 19 of the tremolo arm 18 is threadedly engaged with the mounting hole 20. More specifically, the mounting hole 20 is composed of a large diameter hole portion 21 having diameter slightly larger than that of the male screw portion 19 and bored from the top end surface of the body section 1A to the upper end portion of the block section 1B, a female screw portion 22 having length smaller than that of the male screw portion 19 and bored in communication with the hole portion 21, and a large diameter female screw portion 23 having diameter slightly larger than that of the male screw portion 19 and bored in communication with the female screw portion 22. Lower end portion of the larger diameter female screw portion 23 is opened to the bottom surface of the block section 1B. The male screw portion 19 of the tremolo arm 18 is threadedly engaged with the female screw portion 22 in freely traveling state, and also a torque adjusting screw 25 is threadedly engaged with the large diameter female screw portion 23 in freely traveling state. A spring 24 is interposed between the male screw portion 19 and the torque adjusting screw 25, and the tremolo arm 18 is moved up and down by means of the threadedly engaging action of the male screw portion 19 so that the height thereof can be adjusted. On the other hand, the biasing force of the spring 24 to the male screw portion 19 is varied by means of the threadedly engaging action of the torque adjusting screw 25 so that the rotational torque of the tremolo arm 18 can be adjusted.

Operation of the adjustment mechanism will now be described.

When the string 2 is stretched between the tremolo unit 1 and the peg 3 and the string height adjusting screw 10 is rotated, the saddle portion 6A projecting at front end portion of the bridge saddle 6 can be floated to suitable height thereby the string height can be adjusted to position of any height. When the octave adjusting screw 8 is rotated, the bridge saddle 6 can be traveled thereby the octave adjustment can be performed. When the string height adjustment and the octave adjustment are obtained as above described and the fine tuning screw 15 is rotated, the slider 11 can be traveled in the longitudinal direction thereby fine adjustment of the tension of the string 2 can be performed. When the string height adjustment, the octave adjustment and the tension adjustment of the string 2 are obtained as above described, the tremolo arm 18 is attached to the mounting hole 20 and is operated to rotate the tremolo unit 1 downward so as to perform the up action of tone by increasing the tension of the strings 2, or to rotate it upward so as to perform the down action of tone by decreasing the tension of the strings 2, thus the vibrato performance is feasible.

Since the male screw portion 19 threaded on base portion of the tremolo arm 18 is threadedly engaged with the female screw portion 22 bored at side of the tremolo unit 1, when the tremolo arm 18 is rotated in the tightening direction the height position to the tremolo unit 1 is set low, and when the tremolo arm 18 is rotated in the loosening direction the height position to the tremolo unit 1 is set high. When the height of the tremolo arm 18 is adjusted as above described, upper end portion of the male screw portion 19 may be exposed from the female screw portion 22. However, since the mounting hole 20 is provided with the large diameter hole portion 21 formed at upper side of the female screw portion 22, and moreover a nut for screen is fixed at opening portion of the mounting hole 20 although omitted in the drawings, the exposed portion of the male screw portion 19 is made not to be seen from outside. Since the male screw portion 19 has length larger than that of the female screw portion 22, the top end of the male screw portion 19 may be projected to side of the large diameter female screw portion 23. When the top end of the male screw portion 19 is projected to side of the large diameter female screw portion 23 in such manner and the torque adjusting screw 25 is rotated, the torque adjusting screw 25 compresses the spring 24 interposed between the torque adjusting screw 25 and the male screw portion 19 thereby the biasing force of the spring 24 to the male screw portion 19 can be varied. When the biasing force of the spring 24 to the male screw portion 19 is varied in such manner, the rotational torque of the tremolo arm 18 can be adjusted. That is, when the torque adjusting screw 25 is rotated in the tightening direction and the spring 24 is compressed with large bending deformation, the spring 24 can press the top end of the male screw portion 19 with the large biasing force and the rotational torque of the tremolo arm 18 can be set large. On the other hand, when the torque adjusting screw 25 is rotated in the loosening direction and the spring 24 is compressed with the small bending deformation, the spring 24 can press the top end of the male screw portion 19 with the small biasing force and the rotational torque of the tremolo arm 18 can be set small.

According to the invention constituted as above described, the mounting hole penetrates through the body section and the block portion in the vertical direction and is opened to the tremolo unit, and the male screw portion threaded on base portion of the tremolo arm is threadedly engaged with the mounting hole from upper side in freely traveling state. On the other hand, the torque adjusting screw is threadedly engaged with the mounting hole from lower side in freely traveling state, and the spring for torque adjustment is interposed between the torque adjusting screw and the male screw portion, thereby the vibrato performance is operated, the height adjustment of the tremolo arm and the rotational torque adjustment can be performed independently and freely corresponding to the musical program and preference of the player.

What is claimed is:

1. A tremolo arm adjustment mechanism in an electric guitar comprising a body section holding a bridge saddle thereon, a block section extending downward from the body section, said body section and said block section constituting a tremolo unit, said tremolo unit having front end portion pivotally installed to the body and being rotatable in the vertical direction, and a tremolo arm mounted on the tremolo unit, wherein said tremolo unit is provided with a mounting hole for the tremolo arm penetrating through the body section and the block section in the vertical direction, a male screw portion threaded on base portion of the tremolo arm is threadedly engaged with the mounting hole from upper side in freely traveling state, a torque adjusting screw is threadedly engaged with the mounting hole from lower side in freely traveling state, and a spring is interposed between the torque adjusting screw and the male screw portion.

2. A tremolo arm adjustment mechanism in an electric guitar as set forth in claim 1, wherein a nut for screen is fixed to opening portion of the mounting hole for the tremolo arm.

* * * * *